US006236897B1

(12) United States Patent
Lee et al.

(10) Patent No.: US 6,236,897 B1
(45) Date of Patent: May 22, 2001

(54) CALCULATION AND PRECISION PROCESSING OF CARDIOCLE AND EXPANDED CARDIOID CASING CURVED SURFACES FOR ECCENTRIC ROTOR VANE PUMPS

(76) Inventors: Dae Sung Lee, B-307, Yangli Apartment, #275 Nonhyun-Dong, Kangnam-Ku, Seoul 135-080, Seoul (KR); Yong Hee Park, 608-402 Kummacul, Apt. 932-7 Pyungchon-Dong, Aayang-Si, Kyungki-Do 430-07 (KR)

( * ) Notice: Subject to any disclaimer, the term of this patent is extended or adjusted under 35 U.S.C. 154(b) by 0 days.

(21) Appl. No.: 09/000,440

(22) PCT Filed: Jul. 26, 1996

(86) PCT No.: PCT/KR96/00118

§ 371 Date: Feb. 2, 1999

§ 102(e) Date: Feb. 2, 1999

(87) PCT Pub. No.: WO97/05391

PCT Pub. Date: Feb. 13, 1997

(30) Foreign Application Priority Data

Jul. 27, 1995 (KR) ..... 95-22580

(51) Int. Cl.[7] ..... G06F 17/11; F04C 2/22
(52) U.S. Cl. ..... 700/67; 700/17; 418/150
(58) Field of Search ..... 418/150, 255, 418/261; 700/17, 67

(56) References Cited

U.S. PATENT DOCUMENTS 1,442,198 1/1923 Utley .
1,626,510 4/1927 Chase .
3,877,851 4/1975 Komiya et al. ..... 418/76
3,922,114 * 11/1975 Hamilton et al. ..... 417/366
4,133,617 * 1/1979 Reynaud ..... 418/150
4,300,874 11/1981 Georgiev ..... 418/54
5,511,525 * 4/1996 Jirnov et al. ..... 123/204

FOREIGN PATENT DOCUMENTS

595639 * 12/1947 (GB) .

* cited by examiner

*Primary Examiner*—Thomas Lee
*Assistant Examiner*—Thuan Du
(74) *Attorney, Agent, or Firm*—Morgan, Lewis & Bockius LLP

(57) ABSTRACT

This invention includes the derivation of the exact mathematical expressions for the curvature, either cardiocle or expanded cardioid, of the casing of the springless eccentric rotor vane pump, thereby facilitating the precision manufacture of the curved surfaces of the casing using CNC techniques. As a result, the capacity and accuracy of the eccentric rotor vane pump is greatly improved. As the section manufacture and assembly of the casing becomes possible, the mass production of large-sized pumps of 1-meter or larger diameter is now attainable, hitherto regarded as almost impossible, and therefore production cost is also reduced. The unique design which positions the axis of eccentricity in the lower central part of the axis of rotor rotation results in increase in the rotation speed of the rotor, and leads to reduction of friction between the vane ends and the curved surface of the casing as the weight of the vane does not affect the movement of the rotor.

5 Claims, 11 Drawing Sheets

1 $P=\sqrt{R^2-(R-r)^2\cos^2\theta}-(R-r)\sin\theta$

4' $p_*=\sqrt{r(2R-r)(1+\sin\theta)}$

4" $P=2\sqrt{r(2R-r)}+(R-r)\sin\theta$ $a=\sqrt{r(2R-r)}$ $$a = \sqrt{r(2R-r)}$$

$$4: P = 2\sqrt{R(2R-r)} + (R-r)\sin\theta - \sqrt{R^2-(R-r)^2\cos^2\theta}$$

$$(0^\circ \leq \theta < 180^\circ)$$

1 $P=\sqrt{R^2-(R-r)^2\cos^2\theta}-(R-r)\sin\theta$

4 $p=2\sqrt{r(2R-r)}+(R-r)\sin\theta-\sqrt{R^2-(R-r)^2\cos^2\theta}$

4' $p_0=\sqrt{r(2R-r)}(1+\sin\theta)$

1: $P = \sqrt{R^2-(R-r)^2\cos^2\theta}-(R-r)\sin\theta$

4: $p = 2\sqrt{r(2R-r)}+(R-r)\sin\theta-\sqrt{R^2-(R-r)^2\cos^2\theta}$

1 $P = \sqrt{R^2-(R-r)^2\cos^2\theta}-(R-r)\sin\theta$

4' $p_0 = \sqrt{r(2R-r)}(1+\sin\theta)$

4" $P = 2\sqrt{r(2R-r)}+(R-r)\sin\theta$ $a = \sqrt{r(2R-r)}$

4": $p=2\sqrt{r(2R-r)}+(R-r)\sin\theta$ $a'=2\sqrt{r(2R-r)}$ $b=2\sqrt{r(2R-r)}+R-r$ $c=2\sqrt{r(2R-r)}-R+r$

CALCULATION AND PRECISION PROCESSING OF CARDIOCLE AND EXPANDED CARDIOID CASING CURVED SURFACES FOR ECCENTRIC ROTOR VANE PUMPS

BACKGROUND OF THE INVENTION

1. Field of the Invention

This invention describes the precision processing of curved surfaces of the cardiocle and expanded cardioid casing in springless eccentric rotor vane pumps.

2. Description of the Prior Art

In general, vanes used in eccentric rotor vane pumps are fitted with springs so that their length can vary in line with casing surfaces. However, the eccentric rotor vane pump discussed here has a solid vane of constant length. For this type of eccentric rotor vane pump, the key technology is the accuracy of the casing surface curvatures, to allow the edges of a sliding vane match the surface curves as closely as possible no matter what the rotation angle and the eccentricity of the rotor may be.

However, the exact mathematical descriptions which accurately represent the curves drawn by the movements of the vane edges in an eccentric rotor vane pump have not been found until now. Thus processing of curved casing surfaces has been possible only via the recopy method. This method has several significant weaknesses: (1) Curved surfaces have to be retraced and remodelled each time eccentricity or casing size needs to be changed. (2) Precision processing is not quite possible, especially for large-sized casings. (3) The entire surface of the casing has to be processed at one time. (4) The edges of scraping, sliding vanes make poor contact with casing surfaces.

Moreover, with this recopy method, the accuracy of casing surface processing varies with the eccentricity of the pump, the angle of rotation of the vane, and the distance the vane travels. As there have been no geometrical equations which exactly describe the curves drawn by the vane rotation, such advanced manufacturing techniques as CNC, and processing in sections, have not been available. The only possible manufacturing method was the recopy method, using a prototype curved action.

SUMMARY OF THE INVENTION

In this invention, however, the following equations (A) and (B), which represent the curves drawn by the movement of vanes of fixed length in eccentric rotor vane pumps, are derived on the basis of these curves always falling into two categories, cardiocle and expanded cardioid curves, regardless of rotor eccentricity and vane length:

$$P = 2a\left\{1 + (R - r)\frac{\sin\theta}{2a} - \frac{\sqrt{R^2 - (R - r)^2\cos^2\theta}}{2a}\right\} \text{for cardiocles} \quad (A)$$

$$P = 2a\left\{1 + (R - r)\frac{\sin\theta}{2a}\right\} \text{ for expanded cardioids} \quad (B)$$

Nomenclature in the equations will be discussed in detail later, in reference to FIGS. 1, 3, 5 and 6.

These two equations represent in terms of analytic geometry the curved surfaces of eccentric rotor pump casings, and thereby alow the precision processing of casings using CNC techniques. As the equations do not depend on rotor eccentricity and vane length, casings of any size can be manufactured to the highest levels of accuracy current engineering technology permits; and even further, more processing in sections is now possible.

As a result, not only precision processing, but also mass production, of large-sized springless eccentric rotor vane pumps of 1-meter or larger diameter is now possible, thus making feasible the supply to customers of eccentric rotor vane pumps at more reasonable prices.

In other current eccentric rotor vane pumps, the center of eccentricity of the rotor is set at the upper section or sides of the casing center for better ventilation and smooth valve movement. But the movement of a vane causes friction with the casing surfaces, as the centrifugal force generated by the rotating vane is in the same direction as the gravitation force exerted on the rotor. Therefore the rotation speed of the rotor has to be kept low. However, the vane of the eccentric rotor vane pump being discussed here makes large-area contact with the casing surfaces when sliding on surfaces; and thus the center of eccentricity of the rotor can be placed in the lower section of the casing center. Additionally, the centrifugal force produced by the rotation of the vane is reduced by the weight of the vane. Therefore the rotation speed of the rotor can be sped up.

In particular, as shown in FIG. 10, existing thrust bearings may be used for the processing of large-sized casings of 1-meter or greater diameter, so that the rotor axis can be designed vertically, reducing gravitational pull due to the weight of the rotating vane and increasing operational life.

As the casing diameter increases, the weight of the vane increases and so, too, does the friction produced by the vane when sliding and scraping along the casing surface. For this reason the manufacture of large-sized eccentric rotor vane pumps was regarded as impractical in the past.

By positioning the rotor shaft vertically, it is possible to reduce the friction between the ends of the vane and the casing surface, and thus to increase the size of eccentric rotor pumps. Furthermore the mathematical descriptions of cardiocle and expanded cardioid curves derived and shown in this invention allows the implementation of CNC techniques in the manufacture of casings, and subsequent increase in casing surface accuracy. CNC processing makes possible both mass production and cost reduction.

DESCRIPTION OF THE PREFERRED EMBODIMENTS

The derivation of the two equations for cardiocles and expanded cardioids, in reference to the figures and in terms of analytic geometry, are shown below.

Figure 1:
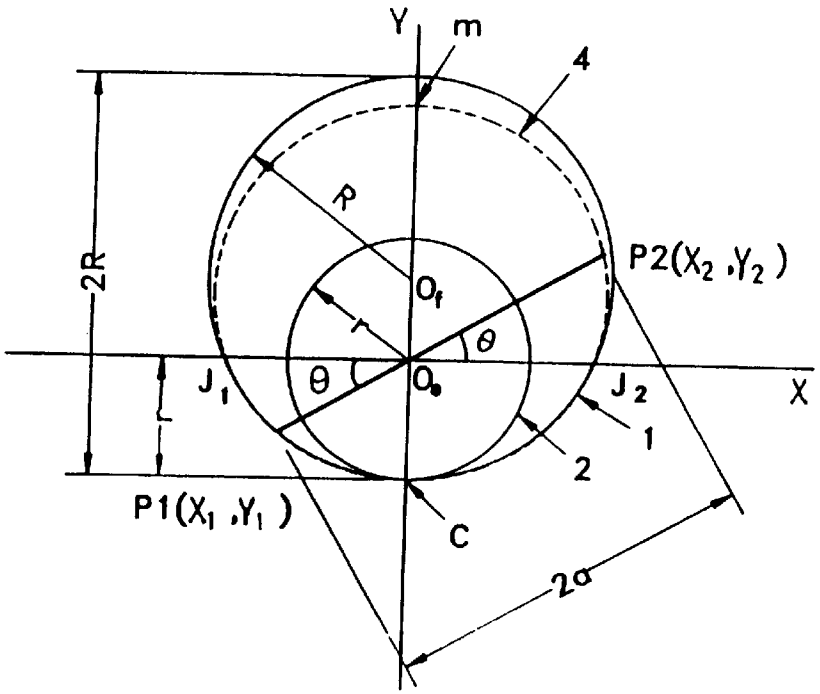
FIG. 1 is a geometric representation of the movement of an eccentric rotor as contained in the invention referred to in this invention.

FIG. 1 shows a cross-section of an eccentric rotor pump in Cartesian coordinates, for geometric analysis of the casing surfaces of the pump. The surface of circular rotor ② touches basic circle ① at point internally Ⓒ. When rotor ② rotates anticlockwise by θ° around the axis of eccentricity, which goes through point Oe, vane ③, which is inserted in rotor ②, also rotates in the same direction as the vane, sliding and scraping along the casing surface. One end of vane ③, $P_1$ ($X_1$, $Y_1$), then moves along the arc of basic circle ①, i.e. $J_1 \rightarrow$ Ⓒ $\rightarrow J_2$. Vane ③ moves in the direction of the diameter along the two guides between the two crescent halves of the assembled rotor ②, passing through the eccentricity center Oe. The other end, $P_2$ ($X_2$, $Y_2$), describes the dotted curve ④.

The length of vane ③ is constant; ie., the distance between $P_1$ ($X_1$, $Y_1$) and $P_2$ ($X_2$, $Y_2$), $2\sqrt{r(2R-r)}=2a$, is also constant. This means that the distance between the two points $J_1$ and $J_2$ on the x-axis, and the distance between the two points on the y-axis, Ⓒ of the perigee and ⓜ of the apogee, are constant. Here, an idealized curve ④ is produced, where the distance between any two points on the curve passing through the center is always constant. If the radius of basic circle ①, R, and the radius of rotor ②, r, are determined, a mathematical equation describing the motion of the two ends of vane ③, $P_1$ and $P_2$, can be derived, with the angle of rotation, θ°, as the only variable.

Then the equation which describes the curve ④ is written in Cartesian coordinates as:

$$X^2+Y^2=\{2\sqrt{r(2R-r)}+(R-r)\sin\theta-\sqrt{R^{2-(R-r)^2\cos^2\theta}}\}^2 \quad (1),$$

where $0° \leqq \theta \leqq 180°$.

In this equation, r denotes the radius of rotor ②, R denotes the radius of basic circle ①, and θ is the angle of rotation of vane ③. This equation, in polar coordinates, is:

$$P=2\sqrt{r(2R-r)}+(R-r)\sin\theta-\sqrt{R^{2-(R-r)^2\cos^2\theta}} \quad (2)$$

The equation describing the basic circle ① can be written as:

$$X^2+Y^2=\{\sqrt{R^{2-(R-r)^2\cos^2\theta}}-(R-r)\sin\theta\}^2 \quad (3)$$

in Cartesian coordinates, and $$P=\sqrt{R^2-(R-r)^2\cos^2\theta}-(R-r)\sin\theta \quad (4)$$

in polar coordinates.

If half of the length of the vane, $\sqrt{r(2R-r)}$, is replaced with a into Equations (1) or (2), the equation becomes:

$$P = 2a\left\{1 + (R-r)\frac{\sin\theta}{2a} - \frac{\sqrt{R^2-(R-r)^2\cos^2\theta}}{2a}\right\} \quad (5)$$

This equation is equivalent to Equations (2) and (4) for curve ① and ④, i.e., the equation for cardiocles. Equation (5) resembles the equation for a simple cardioid, $P=a(1+\sin\theta)$, for dotted curve 4' in FIG. 2. But, Equation (5) is smaller by its third term, $\sqrt{R^2-(R-r)^2\cos^2\theta}$, than that describing curve 4'. In other words, equation (5) shows a curve 4' as a cardioid flattened by the amount $\sqrt{R^{2-(R-r)^2\cos^2\theta}}$ in comparison with an ordinary cardioid 4' in the range, $0° \leqq \theta \leqq 180°$. And this cardioid curve connects at the two points $J_1$ and $J_2$ with the arc of circle ① in the range $180° \leqq \theta \leqq 360°$. This composite curve describes the curve drawn by the full rotation of vane ③. It is named "cardiocle" for being a flattened cardioid in the range, $0° \leqq \theta \leqq 180°$, and for being a circle in the range, $180° \leqq \theta \leqq 360°$.

Figure 2:
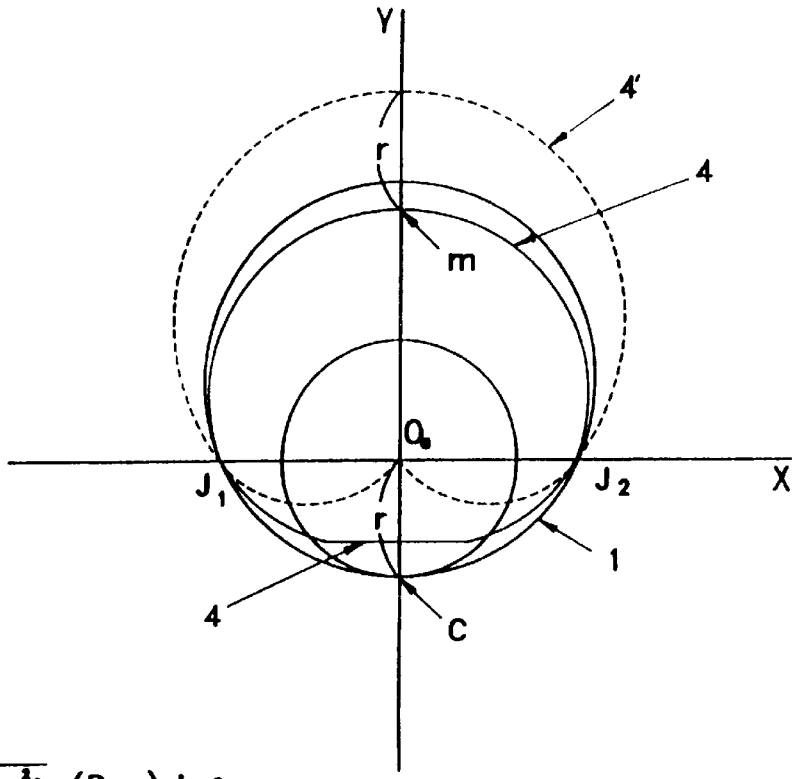
FIG. 2 compares a cardiocle with a simple cardioid.

FIG. 2 gives graphical comparison of the composite cardiocle curve ④ with an ordinary cardioid 4', calculated and drawn using a computer in accordance with the widely-known cardioid equation and the cardiocle equation (5) derived here. As shown in FIG. 2, the distance between the y-intercept of the cardioid 4' and the lower point Oe is $2a=2r\sqrt{r(2R-r)}$; and thus dotted cardiocle curve ④ is the flattened down by r, the radius of the rotor ②, along the y-axis in the range $y \geqq 0$; and expanded below Oe, also by the amount r. Along the y-axis in the range of yso--; Curve ④, a cardiocle, has the composition of a cardioid in the $J_1$–m–$J_2$ section and of a circular arc in the $J_1$–C–$J_2$ section.

Figure 3:
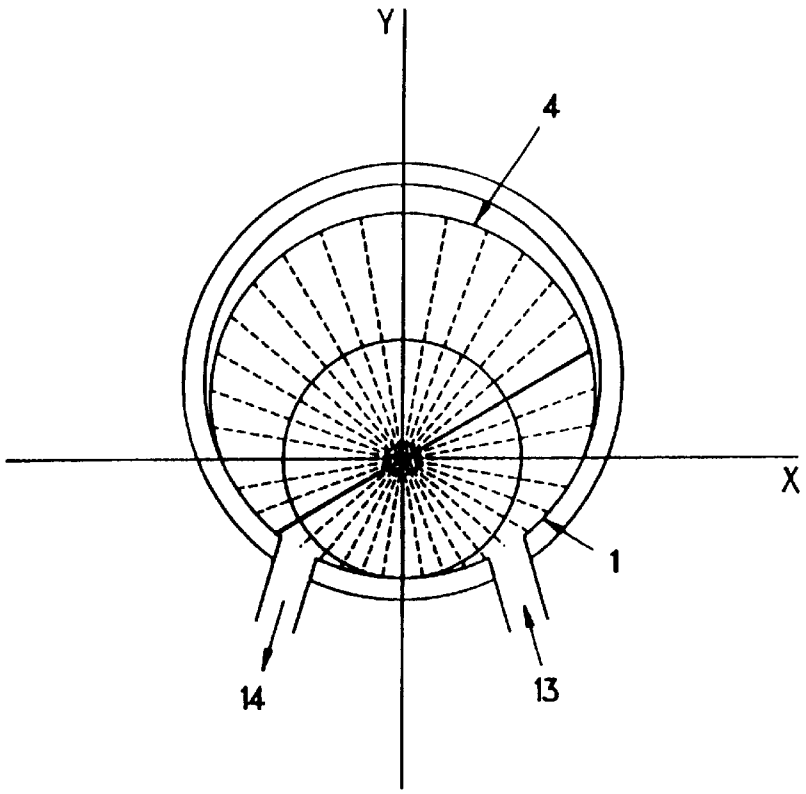
FIG. 3 shows the operation of an eccentric rotor vane pump with a cardiocle casing.

FIG. 3 is a mechanical drawing, which describes the movement of an eccentric rotor pump with a cardiocle casing. An exact equation, in which the only variable is θ, the angle of rotation of vane ③ or rotor ②, can be derived to represent the above-mentioned cardiocle curve drawn by rotation of the vane. Using this equation, accurate casing surfaces can not be processed through CNC techniques.

Figure 4:
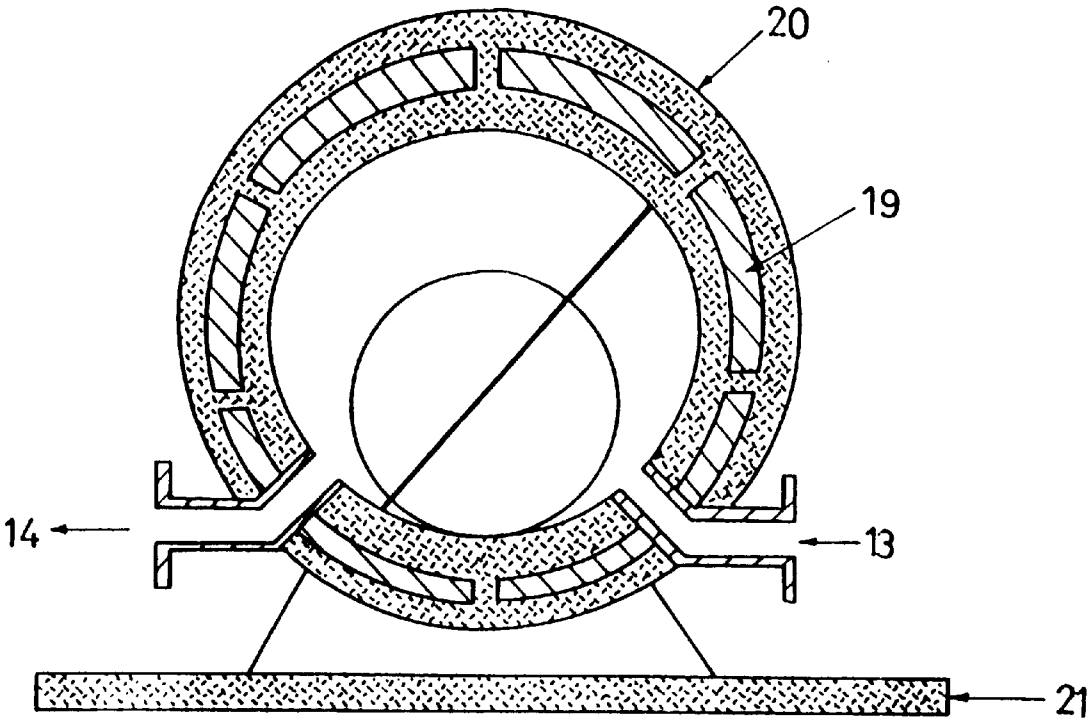
FIG. 4 is the actual description of an eccentric rotor vane pump with a cardiocle casing.

As shown in FIGS. 3 and 4, the casing is fitted with an inlet, ⑬, and an outlet, ⑭, for the flow of liquid into and out of the pump. The inlet and outlet are shown in the fourth and third quadrangles in FIGS. 3. The outer periphery of the casing is surrounded by a cooling chamber, to the outer side of which water jackets are attached.

When the vane mounted on the rotor, as in FIGS. 3 and 4, is rotated anticlockwise, suction force is produced in the casing section containing inlet ⑬, due to pressure decrease, and drainage force in the section containing outlet ⑭, due to pressure increase. Fluid inflow and outflow are repeated in tandem with the rotation of the rotor.

In addition to the heat generated by friction between rotating rotor ② and vane ③ and the casing surface ④, additional heat is generated due to the continuous kinetic movement of fluid molecules during the repeated inflow and outflow of the liquid. This problem can be solved by applying current water-cooling or air-cooling techniques. Other current eccentric rotor vane pumps require substantial amounts of high-viscosity sealing oil, as their vane ends do not closely or uniformly scrape along tne casing surfaces due to their inaccurately processed casings. However, the equations for curve ④ derived in this invention make possible the processing of casing surfaces to the highest possible degree of accuracy, thus requiring only small amounts of low-viscosity sealing oil and making operations more economical.

In order to acquire different curvatures, a curve was drawn using Equation (5) minus the last term, $\sqrt{R^2-(R-r)^2\cos^2\theta}$. This new curve also shows that the length of the vane, or casing diameter, remains constant during full rotations.

From this, a new equation (6), for what we will call an "expanded cardioid" from now on, is derived.

$$P = 2a\left\{1 + \frac{(R-r)}{2a}\sin\theta\right\} \tag{6}$$

Figure 5:
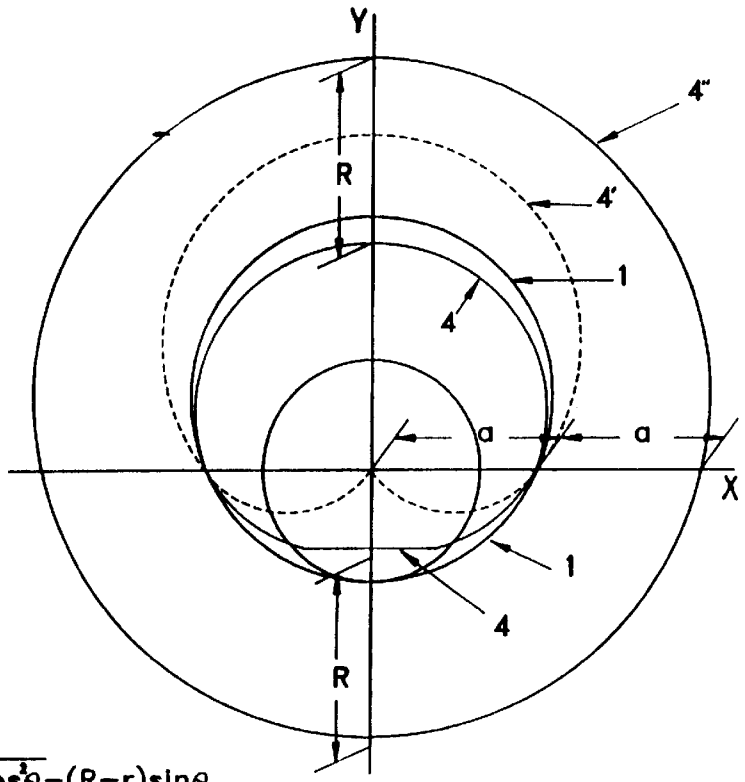
FIG. 5 compares the curvatures of cardiocle and expanded cardioid casings.
Figure 6:
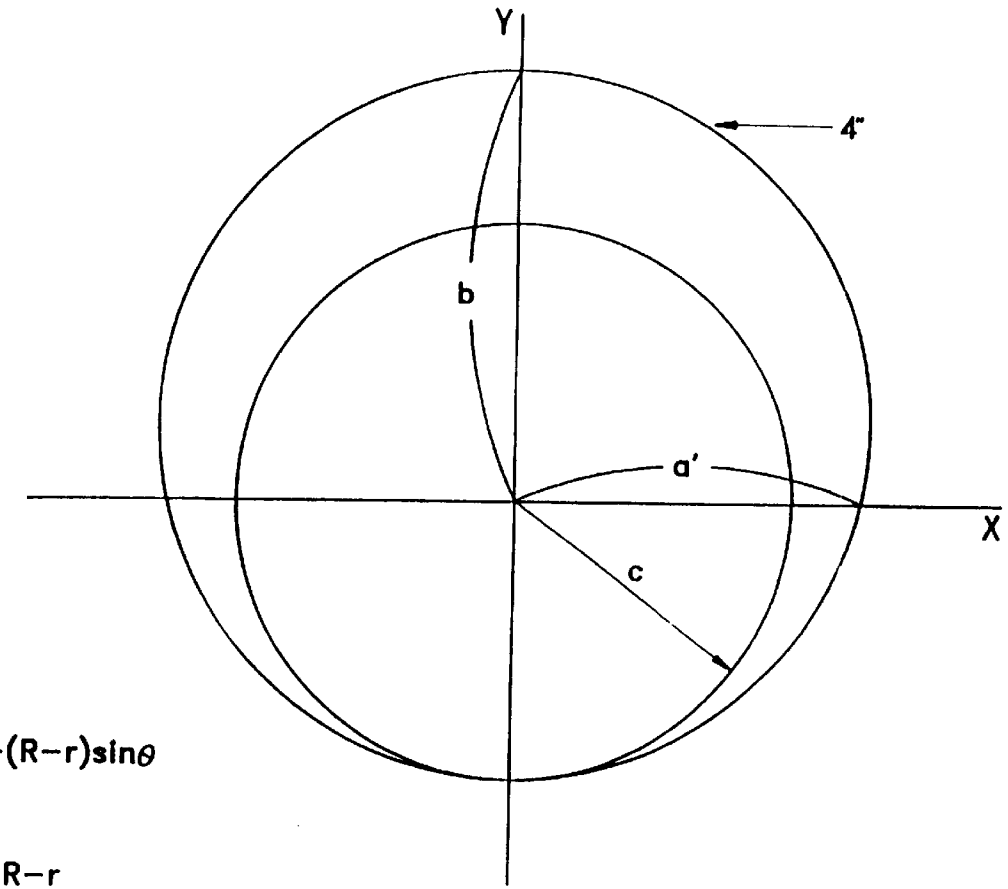
FIG. 6 shows the relationship between the size of an eccentric rotor and an expanded cardioid.

This new equation is represented by curve 4" in FIG. 5. This curve is not defined as an ellipse by mathematical definition, although it looks like one. Equation (6) shows that it is an expanded form of the ordinary cardioid ($P=a(1+\sin\theta)$); and is thus named an "expanded cardioid". As shown in FIG. 5, the expanded cardioid curve 4" is an enlargement, by R the radius of basic circle ①, of the cardiocle curve ④, in both directions along the y-axis. The length of the vane for this curve, as shown in FIG. 6, is exactly twice that for the cardiocles as shown in FIGS. 1 and 2. This equation can be effectively and ideally applied in the precision processing of another type of eccentric rotor vane pump with expanded cardioid casing. As this expanded cardioid curve is closer to a circle than a cardiocle, rotor movement is expected to be smoother.

In the case of the expanded cardioid curve 4" shown in FIG. 6, the radius of the rotor is $2\sqrt{r(2R-r)}-R+r$. The rotor is positioned symmetrically, $(2\sqrt{r(2R-r)}-R+r)$ above the lower y-intercept and $(2\sqrt{r(2R-r)}+R-r)$ below the upper y-intercept, on the y-axis. Thus the center of the rotor can be exactly determined.

An interesting comparison can be made here; Equation (6) for the expanded cardioid suffices for the range $0° \leqq \theta \leqq 360°$, while Equation(5) for the cardiocle suffices only for the range $0 \leqq \theta \leqq 180°$.

The equations (1) through (6) derived in this invention form a mathematical basis for computer numerical controlled manufacturing of casings of eccentric rotor vane pumps. On the basis of these equations, part processing and assembly of casings of sizes far surpassing the limits set by currently available machine tool technology is now possible for any R and r, the respective radii of any arbitrary primary circle and any eccentric rotor. As CNC techniques become used instead of the tradtional recopy method, mass production becomes possible, thus reducing production costs and allowing the production good quality pumps at reasonable prices. Furthermore, as manufacturing in sections becomes possible, no additional processing equipment is required for large-size casings.

Figure 7:
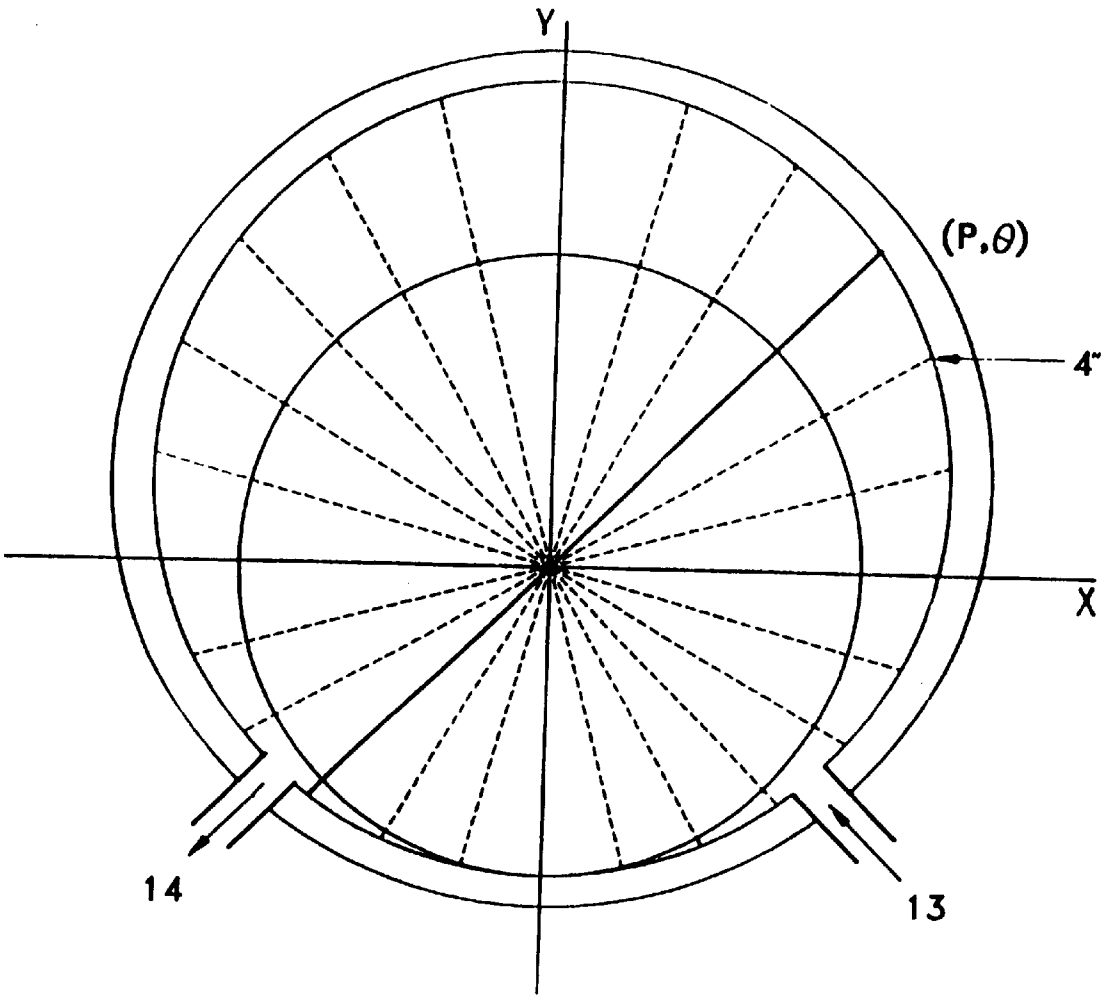
FIG. 7 shows the operation of an eccentric rotor vane pump with an expanded cardioid casing.
Figure 8:
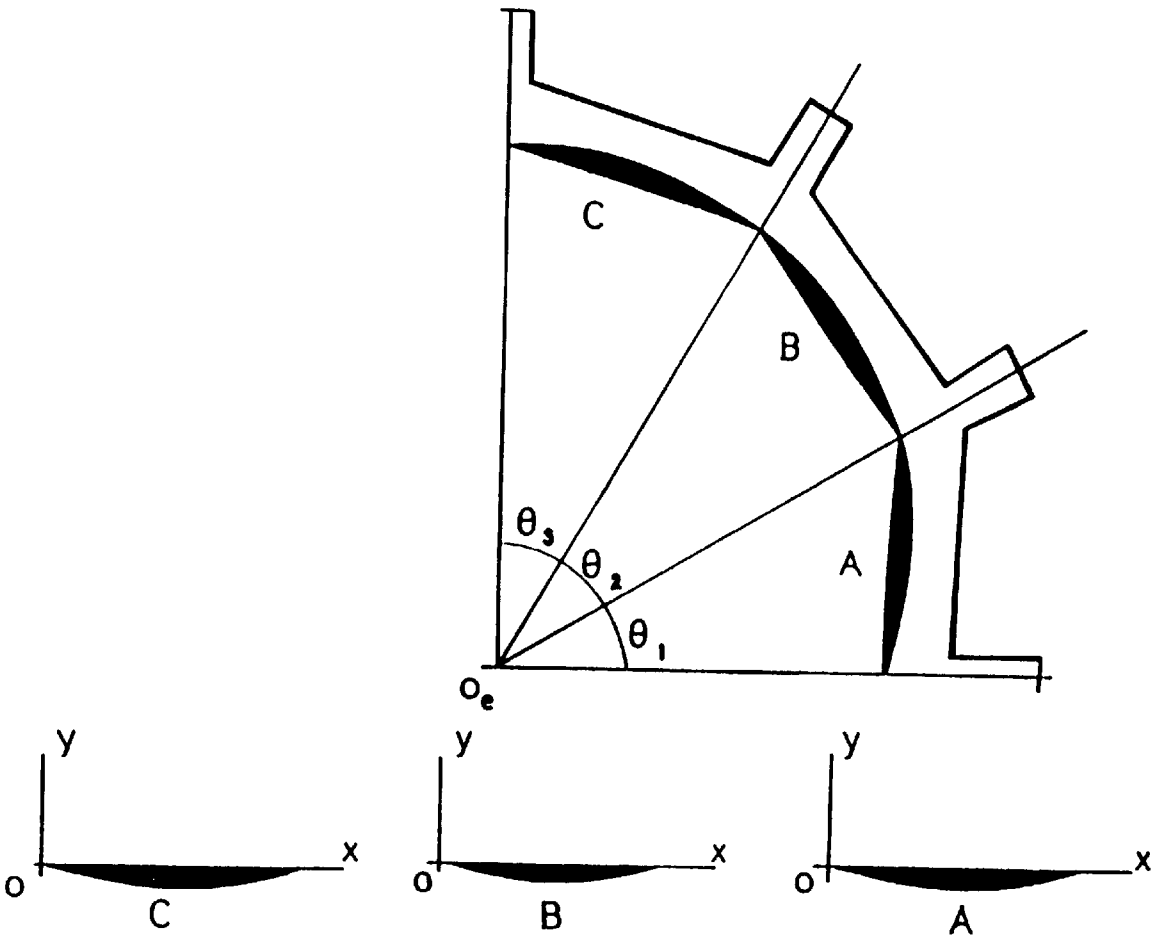
FIG. 8 describes section processing of a pump casing using the methodology introduced in this invention.

As one practical example of this, invention, FIG. 7 illustrates the operation of a springless eccentric rotor vane pump with an expanded cardioid casing. FIG. 8 describes section processing of a pump casing where the radius R of the basic circle ① is 1,000 mm and the radius r of the eccentric rotor ② is 600 mm. The shaded areas in sectors A, B and C are the parts to be processed in sections using the methodology introduced in this invention. The following table 1 shows the coordinates (x, y) calculated with the equations which describe the two-dimensional cross section of the casing (FIG. 8), over the range $0 \leqq \theta \leqq 90°$.

TABLE 1

| X | Y |
|---|---|
| $0° \leqq \theta \leqq 30°$ | |
| 0.327692 | 0.120531 |
| 0.655831 | 0.240369 |
| 0.984415 | 0.359512 |
| 1.313441 | 0.477958 |

TABLE 1-continued

| X | Y |
|---|---|
| 1.642910 | 0.595706 |
| 1.972818 | 0.712755 |
| 2.303164 | 0.829101 |
| 2.633947 | 0.944745 |
| 2.965165 | 1.059685 |
| 3.296817 | 1.173918 |
| 3.628899 | 1.287444 |
| 3.961412 | 1.400260 |
| 4.294353 | 1.512366 |
| 4.627720 | 1.623759 |
| 4.961512 | 1.734439 |
| 5.295727 | 1.844403 |
| 5.630364 | 1.953650 |
| 5.965420 | 2.062180 |
| 6.300894 | 2.169989 |
| 6.636784 | 2.277076 |
| 6.973088 | 2.383441 |
| 7.309805 | 2.489081 |
| 7.646933 | 2.593996 |
| 7.984470 | 2.698183 |
| 8.322415 | 2.801641 |
| 8.660765 | 2.904369 |
| 8.999519 | 3.006365 |
| 9.338676 | 3.107628 |
| 9.678233 | 3.208156 |
| 10.018189 | 3.307948 |
| 10.358541 | 3.407003 |
| 10.699289 | 3.505318 |
| 11.040429 | 3.602893 |
| 11.381962 | 3.699726 |
| 11.723883 | 3.795816 |
| 12.066193 | 3.891162 |
| 12.408889 | 3.985761 |
| 12.751969 | 4.079612 |
| 13.095432 | 4.172715 |
| 13.439275 | 4.265068 |
| 13.783497 | 4.356669 |
| 14.128096 | 4.447516 |
| 14.473070 | 4.537610 |
| 14.818417 | 4.626948 |
| 15.164135 | 4.715528 |
| 15.510223 | 4.803350 |
| 15.856679 | 4.890413 |
| 16.203500 | 4.976714 |
| 16.550685 | 5.062252 |
| 16.898233 | 5.147027 |
| 17.246140 | 5.231037 |
| 17.594406 | 5.314281 |
| 17.943028 | 5.396756 |
| 18.292005 | 5.478463 |
| 18.641335 | 5.559399 |
| 18.991015 | 5.639564 |
| 19.341044 | 5.718956 |
| 19.691420 | 5.797573 |
| 20.042140 | 5.875415 |
| 20.393204 | 5.952481 |
| 20.744610 | 6.028768 |
| 21.096354 | 6.104277 |
| 21.448436 | 6.179005 |
| 21.800853 | 6.252951 |
| 22.153604 | 6.326114 |
| 22.506686 | 6.398494 |
| 22.860097 | 6.470088 |
| 23.213837 | 6.540895 |
| 23.567901 | 6.610914 |
| 23.922290 | 6.680145 |
| 24.277000 | 6.748586 |
| 24.632031 | 6.816235 |
| 24.987379 | 6.883092 |
| 25.343042 | 6.949155 |
| 25.699020 | 7.014423 |
| 26.055310 | 7.078895 |
| 26.411909 | 7.142570 |
| 26.766816 | 7.205447 |
| 27.126030 | 7.267524 |
| 27.483547 | 7.328801 |
| 27.841366 | 7.389276 |

TABLE 1-continued

| X | Y |
|---|---|
| 28.199487 | 7.448948 |
| 28.557905 | 7.507817 |
| 28.916620 | 7.565881 |
| 29.275628 | 7.623138 |
| 29.634929 | 7.679589 |
| 29.994519 | 7.735231 |
| 30.354397 | 7.790063 |
| 30.714561 | 7.844085 |
| 31.075008 | 7.897296 |
| 31.435738 | 7.949694 |
| 31.796747 | 8.001279 |
| 32.158033 | 8.052049 |
| 32.519596 | 8.102003 |
| 32.881432 | 8.151140 |
| 33.243539 | 8.199460 |
| 33.605916 | 8.246961 |
| 33.968560 | 8.293642 |
| 34.331470 | 8.339502 |
| 34.694643 | 8.384541 |
| 35.058077 | 8.428756 |
| 35.421770 | 8.472148 |
| 35.785720 | 8.514715 |
| 36.149926 | 8.556457 |
| 36.514384 | 8.597372 |
| 36.879093 | 8.637459 |
| 37.244051 | 8.676718 |
| 37.609255 | 8.715147 |
| 37.974704 | 8.752745 |
| 38.340396 | 8.789513 |
| 38.706327 | 8.825448 |
| 39.072498 | 8.860550 |
| 39.438904 | 8.894817 |
| 39.805544 | 8.928250 |
| 40.172416 | 8.960846 |
| 40.539519 | 8.992606 |
| 40.906848 | 9.023528 |
| 41.274404 | 9.053612 |
| 41.642183 | 9.082856 |
| 42.010183 | 9.111260 |
| 42.378403 | 9.138823 |
| 42.746839 | 9.165543 |
| 43.115491 | 9.191421 |
| 43.484355 | 9.216455 |
| 43.853431 | 9.240645 |
| 44.222714 | 9.263989 |
| 44.592205 | 9.286458 |
| 44.961899 | 9.308139 |
| 45.331796 | 9.328943 |
| 45.701892 | 9.348898 |
| 46.072187 | 9.368003 |
| 46.442677 | 9.386259 |
| 46.813361 | 9.403664 |
| 47.184236 | 9.420217 |
| 47.555300 | 9.435918 |
| 47.926551 | 9.450766 |
| 48.297987 | 9.464759 |
| 48.669606 | 9.477899 |
| 49.041406 | 9.490183 |
| 49.413384 | 9.501610 |
| 49.785638 | 9.512181 |
| 50.157866 | 9.521895 |
| 50.530366 | 9.530751 |
| 50.903036 | 9.538747 |
| 51.275873 | 9.545884 |
| 51.648875 | 9.552161 |
| 52.022041 | 9.557577 |
| 52.395368 | 9.562131 |
| 52.768853 | 9.565823 |
| 53.142495 | 9.568652 |
| 53.516291 | 9.570618 |
| 53.890239 | 9.571719 |
| 54.264338 | 9.571956 |
| 54.638584 | 9.571327 |
| 55.012976 | 9.569833 |
| 55.387511 | 9.567471 |
| 55.762187 | 9.564243 |
| 56.137002 | 9.560146 |

TABLE 1-continued

| X | Y |
|---|---|
| 56.511954 | 9.555181 |
| 56.887041 | 9.549347 |
| 57.262260 | 9.542644 |
| 57.637609 | 9.535070 |
| 58.013086 | 9.526625 |
| 58.388688 | 9.517310 |
| 58.764415 | 9.507122 |
| 59.140262 | 9.496062 |
| 59.516228 | 9.484130 |
| 59.892312 | 9.471323 |
| 60.268509 | 9.457643 |
| 60.644820 | 9.443089 |
| 61.021240 | 9.427659 |
| 61.397763 | 9.411354 |
| 61.774402 | 9.394173 |
| 62.151139 | 9.376116 |
| 62.527978 | 9.357182 |
| 62.904916 | 9.337370 |
| 63.281950 | 9.316681 |
| 63.659079 | 9.295113 |
| 64.036300 | 9.272667 |
| 64.413612 | 9.249341 |
| 64.791011 | 9.225136 |
| 65.168495 | 9.200050 |
| 65.546063 | 9.174085 |
| 65.923712 | 9.147238 |
| 66.301440 | 9.119510 |
| 66.679245 | 9.090900 |
| 67.057124 | 9.061409 |
| 67.435075 | 9.031035 |
| 67.813096 | 8.999778 |
| 68.191184 | 8.967638 |
| 68.569338 | 8.934614 |
| 68.947555 | 8.900706 |
| 69.325833 | 8.865914 |
| 69.704170 | 8.830238 |
| 70.082563 | 8.793676 |
| 70.461010 | 8.756229 |
| 70.839508 | 8.717897 |
| 71.218057 | 8.678678 |
| 71.596653 | 8.638574 |
| 71.975294 | 8.597583 |
| 72.353978 | 8.555705 |
| 72.732702 | 8.512939 |
| 73.111465 | 8.469287 |
| 73.490263 | 8.424747 |
| 73.869096 | 8.379318 |
| 74.247960 | 8.333002 |
| 74.626854 | 8.285797 |
| 75.005774 | 8.237704 |
| 75.384719 | 8.188721 |
| 75.763687 | 8.138849 |
| 76.142675 | 8.088088 |
| 76.521681 | 8.036438 |
| 76.900703 | 7.983897 |
| 77.279738 | 7.930467 |
| 77.658784 | 7.876146 |
| 78.037840 | 7.820934 |
| 78.416902 | 7.764833 |
| 78.795968 | 7.707840 |
| 79.175036 | 7.649956 |
| 79.554105 | 7.591181 |
| 79.933171 | 7.531515 |
| 80.312232 | 7.470958 |
| 80.691287 | 7.409509 |
| 81.070332 | 7.347168 |
| 81.449366 | 7.283935 |
| 81.828386 | 7.219811 |
| 82.207390 | 7.154794 |
| 82.586376 | 7.088885 |
| 82.965341 | 7.022084 |
| 83.344283 | 6.954391 |
| 83.723201 | 6.885804 |
| 84.102091 | 6.816326 |
| 84.480952 | 6.745955 |
| 84.859781 | 6.674691 |
| 85.238575 | 6.602534 |

TABLE 1-continued

| X | Y |
|---|---|
| 85.617333 | 6.529485 |
| 85.996053 | 6.455542 |
| 86.374732 | 6.380707 |
| 86.753367 | 6.304979 |
| 87.131957 | 6.228358 |
| 87.510500 | 6.150843 |
| 87.888992 | 6.072436 |
| 88.267432 | 5.993136 |
| 88.645818 | 5.912943 |
| 89.024147 | 5.831857 |
| 89.402417 | 5.749877 |
| 89.780626 | 5.667005 |
| 90.158771 | 5.583240 |
| 90.536850 | 5.498582 |
| 90.914861 | 5.413031 |
| 91.292802 | 5.326588 |
| 91.670670 | 5.239251 |
| 92.048464 | 5.151022 |
| 92.426180 | 5.061900 |
| 92.803817 | 4.971886 |
| 93.181372 | 4.880979 |
| 93.558844 | 4.789180 |
| 93.336229 | 4.696488 |
| 94.313526 | 4.602904 |
| 94.690732 | 4.508428 |
| 95.067845 | 4.413060 |
| 95.444863 | 4.316801 |
| 95.821784 | 4.219649 |
| 96.198605 | 4.121606 |
| 96.575324 | 4.022671 |
| 96.951938 | 3.922846 |
| 97.328447 | 3.822128 |
| 97.704847 | 3.720520 |
| 98.081135 | 3.618021 |
| 98.457311 | 3.514632 |
| 98.833371 | 3.410352 |
| 99.209313 | 3.305181 |
| 99.585136 | 3.199121 |
| 99.960836 | 3.092170 |
| 100.336412 | 2.984330 |
| 100.711861 | 2.875600 |
| 101.087181 | 2.765981 |
| 101.462370 | 2.655473 |
| 101.837426 | 2.544076 |
| 102.212346 | 2.431791 |
| 102.587128 | 2.318617 |
| 102.961771 | 2.204555 |
| 103.336270 | 2.089605 |
| 103.710625 | 1.973768 |
| 104.084834 | 1.857043 |
| 104.458893 | 1.739431 |
| 104.832801 | 1.620933 |
| 105.206555 | 1.501548 |
| 105.580154 | 1.381277 |
| 105.953595 | 1.260120 |
| 106.326875 | 1.138077 |
| 106.699993 | 1.015149 |
| 107.072946 | 0.891337 |
| 107.445733 | 0.766639 |
| 107.818350 | 0.641058 |
| 108.190796 | 0.514592 |
| 108.563069 | 0.387243 |
| 108.935165 | 0.259011 |
| 109.307084 | 0.129896 |
| $30° \leqq \theta \leqq 60°$ | |
| 0.371910 | 0.129871 |
| 0.744227 | 0.258937 |
| 1.116948 | 0.387199 |
| 1.490071 | 0.514655 |
| 1.863596 | 0.641303 |
| 2.237519 | 0.767143 |
| 2.611839 | 0.892174 |
| 2.986553 | 1.016395 |
| 3.361661 | 1.139804 |
| 3.737159 | 1.262401 |
| 4.113046 | 1.384184 |

TABLE 1-continued

| X | Y |
|---|---|
| 4.489319 | 1.505153 |
| 4.865978 | 1.625307 |
| 5.243019 | 1.744643 |
| 5.620441 | 1.863163 |
| 5.998241 | 1.980864 |
| 6.376419 | 2.097745 |
| 6.754971 | 2.213805 |
| 7.133896 | 2.329045 |
| 7.513192 | 2.443461 |
| 7.892849 | 2.557052 |
| 8.272873 | 2.669819 |
| 8.653262 | 2.781760 |
| 9.034014 | 2.892875 |
| 9.415126 | 3.003162 |
| 9.796596 | 3.112621 |
| 10.178424 | 3.221251 |
| 10.560605 | 3.329051 |
| 10.943140 | 3.436020 |
| 11.326025 | 3.542157 |
| 11.709258 | 3.647461 |
| 12.092838 | 3.751931 |
| 12.476762 | 3.855566 |
| 12.861028 | 3.958365 |
| 13.245635 | 4.060329 |
| 13.630580 | 4.161454 |
| 14.015861 | 4.261742 |
| 14.401477 | 4.361190 |
| 14.787424 | 4.459798 |
| 15.173701 | 4.557565 |
| 15.560307 | 4.654490 |
| 15.947238 | 4.750573 |
| 16.334493 | 4.845812 |
| 16.722070 | 4.940207 |
| 17.109967 | 5.033756 |
| 17.498181 | 5.126460 |
| 17.886711 | 5.218317 |
| 18.275554 | 5.309326 |
| 18.664709 | 5.399487 |
| 19.054173 | 5.488798 |
| 19.443945 | 5.577259 |
| 19.834021 | 5.664870 |
| 20.224401 | 5.751628 |
| 20.615082 | 5.837535 |
| 21.006062 | 5.922588 |
| 21.397338 | 6.006786 |
| 21.788910 | 6.090131 |
| 22.180774 | 6.172619 |
| 22.572928 | 6.254252 |
| 22.965372 | 6.335027 |
| 23.358101 | 6.414945 |
| 23.751115 | 6.494004 |
| 24.144411 | 6.572203 |
| 24.537987 | 6.649543 |
| 24.931841 | 6.726022 |
| 25.325971 | 6.801640 |
| 25.720375 | 6.876395 |
| 26.115050 | 6.950288 |
| 26.509996 | 7.023317 |
| 26.905208 | 7.095482 |
| 27.300686 | 7.166782 |
| 27.696427 | 7.237216 |
| 28.092429 | 7.306784 |
| 28.488691 | 7.375485 |
| 28.885209 | 7.443319 |
| 29.281982 | 7.510284 |
| 29.679007 | 7.576380 |
| 30.076283 | 7.641607 |
| 30.473808 | 7.705964 |
| 30.871579 | 7.769450 |
| 31.269593 | 7.832064 |
| 31.667850 | 7.893806 |
| 32.066347 | 7.954676 |
| 32.465082 | 8.014672 |
| 32.864052 | 8.073795 |
| 33.263256 | 8.132042 |
| 33.662691 | 8.189415 |
| 34.062356 | 8.245912 |

TABLE 1-continued

| X | Y |
|---|---|
| 34.462247 | 8.301533 |
| 34.862364 | 8.356277 |
| 35.262703 | 8.410144 |
| 35.663263 | 8.463133 |
| 36.064042 | 8.515243 |
| 36.465037 | 8.566474 |
| 36.866246 | 8.616825 |
| 37.267667 | 8.666297 |
| 37.669299 | 8.714887 |
| 38.071138 | 8.762597 |
| 38.473183 | 8.809424 |
| 38.875431 | 8.855370 |
| 39.277881 | 8.900432 |
| 39.680530 | 8.944612 |
| 40.083376 | 8.987907 |
| 40.486417 | 9.030319 |
| 40.889651 | 9.071845 |
| 41.293076 | 9.112486 |
| 41.696689 | 9.152242 |
| 42.100488 | 9.191111 |
| 42.504472 | 9.229094 |
| 42.908637 | 9.266190 |
| 43.312983 | 9.302398 |
| 43.717506 | 9.337718 |
| 44.122205 | 9.372149 |
| 44.527077 | 9.405692 |
| 44.932120 | 9.438345 |
| 45.337332 | 9.470109 |
| 45.742711 | 9.500983 |
| 46.148255 | 9.530965 |
| 46.553962 | 9.560057 |
| 46.959829 | 9.588258 |
| 47.365854 | 9.615567 |
| 47.772035 | 9.641983 |
| 48.178370 | 9.667507 |
| 48.584857 | 9.692138 |
| 48.991494 | 9.715876 |
| 49.398278 | 9.738720 |
| 49.805207 | 9.760671 |
| 50.212279 | 9.781726 |
| 50.619492 | 9.801887 |
| 51.026844 | 9.821153 |
| 51.434333 | 9.839524 |
| 51.841955 | 9.856998 |
| 52.249710 | 9.873577 |
| 52.657595 | 9.889259 |
| 53.065608 | 9.904045 |
| 53.473747 | 9.917933 |
| 53.882009 | 9.930925 |
| 54.290393 | 9.943018 |
| 54.698896 | 9.954214 |
| 55.107515 | 9.964511 |
| 55.516250 | 9.973910 |
| 55.925097 | 9.982410 |
| 56.334055 | 9.990012 |
| 56.743121 | 9.996714 |
| 57.152293 | 10.002516 |
| 57.561569 | 10.007418 |
| 57.970947 | 10.011421 |
| 58.380425 | 10.014523 |
| 58.790000 | 10.016725 |
| 59.199670 | 10.018025 |
| 59.609433 | 10.018425 |
| 60.019288 | 10.017924 |
| 60.429231 | 10.016521 |
| 60.839260 | 10.014217 |
| 61.249374 | 10.011011 |
| 61.659570 | 10.006903 |
| 62.069846 | 10.001892 |
| 62.480200 | 9.995979 |
| 62.890629 | 9.989164 |
| 63.301132 | 9.981446 |
| 63.711707 | 9.972825 |
| 64.122350 | 9.963300 |
| 64.533060 | 9.952873 |
| 64.943836 | 9.941542 |
| 65.354673 | 9.929308 |

TABLE 1-continued

| X | Y |
|---|---|
| 65.765572 | 9.916170 |
| 66.176528 | 9.902128 |
| 66.587540 | 9.887182 |
| 66.998607 | 9.871332 |
| 67.409725 | 9.854578 |
| 67.820892 | 9.836919 |
| 68.232107 | 9.818357 |
| 68.643367 | 9.798889 |
| 69.054670 | 9.778517 |
| 69.466014 | 9.757241 |
| 69.877396 | 9.735059 |
| 70.288815 | 9.711973 |
| 70.700268 | 9.687982 |
| 71.111754 | 9.663086 |
| 71.523269 | 9.637284 |
| 71.934812 | 9.610578 |
| 72.346381 | 9.582966 |
| 72.757972 | 9.554450 |
| 73.169586 | 9.525027 |
| 73.581218 | 9.494700 |
| 73.992867 | 9.463467 |
| 74.404531 | 9.431329 |
| 74.816207 | 9.398286 |
| 75.227894 | 9.364337 |
| 75.639589 | 9.329483 |
| 76.051290 | 9.293723 |
| 76.462994 | 9.257058 |
| 76.874701 | 9.219488 |
| 77.286407 | 9.181012 |
| 77.698110 | 9.141631 |
| 78.109808 | 9.101344 |
| 78.521499 | 9.060152 |
| 78.933182 | 9.018055 |
| 79.344852 | 8.975053 |
| 79.756510 | 8.931145 |
| 80.168151 | 8.886333 |
| 80.579775 | 8.840615 |
| 80.991379 | 8.793993 |
| 81.402960 | 8.746465 |
| 81.814517 | 8.698032 |
| 82.226048 | 8.648695 |
| 82.637550 | 8.598453 |
| 83.049021 | 8.547307 |
| 83.460459 | 8.495255 |
| 83.871862 | 8.442300 |
| 84.283227 | 8.388440 |
| 84.694553 | 8.333676 |
| 85.105837 | 8.278008 |
| 85.517078 | 8.221436 |
| 85.928272 | 8.163960 |
| 86.339419 | 8.105580 |
| 86.750515 | 8.046297 |
| 87.161558 | 7.986110 |
| 87.572547 | 7.925020 |
| 87.983480 | 7.863027 |
| 88.394353 | 7.800131 |
| 88.805165 | 1.736332 |
| 89.215914 | 7.671630 |
| 89.626597 | 7.606026 |
| 90.037214 | 7.539520 |
| 90.447760 | 7.472112 |
| 90.858234 | 7.403801 |
| 91.268635 | 7.334589 |
| 91.678959 | 7.264476 |
| 92.089205 | 7.193461 |
| 92.499371 | 7.121545 |
| 92.909454 | 7.048728 |
| 93.319452 | 6.975011 |
| 93.729363 | 6.900393 |
| 94.139186 | 6.824875 |
| 94.548917 | 6.748457 |
| 94.958555 | 6.671139 |
| 95.368097 | 6.592922 |
| 95.777542 | 6.513805 |
| 96.186888 | 6.433790 |
| 96.596131 | 6.352876 |
| 97.005270 | 6.271063 |

TABLE 1-continued

| X | Y |
|---|---|
| 97.414303 | 6.188352 |
| 97.823228 | 6.104744 |
| 98.232043 | 6.020237 |
| 98.640745 | 5.934834 |
| 99.049332 | 5.848533 |
| 99.457803 | 5.761336 |
| 99.866155 | 5.673243 |
| 100.274385 | 5.584253 |
| 100.682493 | 5.494367 |
| 101.090475 | 5.403586 |
| 101.498330 | 5.311910 |
| 101.906055 | 5.219339 |
| 102.313648 | 5.125874 |
| 102.721108 | 5.031514 |
| 103.128432 | 4.936261 |
| 103.535618 | 4.840114 |
| 103.942664 | 4.743074 |
| 104.349567 | 4.645142 |
| 104.756326 | 4.546317 |
| 105.162939 | 4.446600 |
| 105.569403 | 4.345991 |
| 105.975716 | 4.244492 |
| 106.381876 | 4.142101 |
| 106.787882 | 4.038820 |
| 107.193730 | 3.934649 |
| 107.599420 | 3.829588 |
| 108.004948 | 3.723638 |
| 108.410312 | 3.616799 |
| 108.815512 | 3.509072 |
| 109.220543 | 3.400456 |
| 109.625406 | 3.290954 |
| 110.030096 | 3.180563 |
| 110.434612 | 3.069287 |
| 110.838953 | 2.957124 |
| 111.243116 | 2.844075 |
| 111.647098 | 2.730141 |
| 112.050898 | 2.615321 |
| 112.454514 | 2.499618 |
| 112.857944 | 2.383030 |
| 113.261185 | 2.265559 |
| 113.664235 | 2.147205 |
| 114.067093 | 2.027968 |
| 114.469756 | 1.907849 |
| 114.872223 | 1.786849 |
| 115.274490 | 1.664967 |
| 115.676556 | 1.542205 |
| 116.078420 | 1.418563 |
| 116.480078 | 1.294041 |
| 116.881529 | 1.168640 |
| 117.282771 | 1.042361 |
| 117.683802 | 0.915203 |
| 118.084619 | 0.787168 |
| 118.485221 | 0.658256 |
| 118.885605 | 0.528468 |
| 119.285769 | 0.397804 |
| 119.685712 | 0.266264 |
| 120.085432 | 0.133850 |
| 120.484925 | 0.000561 |
| $60° \leqq \theta \leqq 90°$ | |
| 0.400229 | 0.131263 |
| 0.800795 | 0.261688 |
| 1.201698 | 0.391276 |
| 1.602934 | 0.520024 |
| 2.004502 | 0.647934 |
| 2.406401 | 0.775002 |
| 2.808627 | 0.901230 |
| 3.211179 | 1.026617 |
| 3.614056 | 1.151160 |
| 4.017254 | 1.274861 |
| 4.420772 | 1.397717 |
| 4.824608 | 1.519729 |
| 5.228761 | 1.640895 |
| 5.633227 | 1.761215 |
| 6.038005 | 1.880689 |
| 6.443093 | 1.999314 |
| 6.848490 | 2.117092 |

TABLE 1-continued

| X | Y |
|---|---|
| 7.254192 | 2.234021 |
| 7.660198 | 2.350099 |
| 8.066506 | 2.465328 |
| 8.473114 | 2.579706 |
| 8.880020 | 2.693232 |
| 9.287221 | 2.805905 |
| 9.694717 | 2.917726 |
| 10.102504 | 3.028693 |
| 10.510582 | 3.138805 |
| 10.918947 | 3.248063 |
| 11.327598 | 3.356465 |
| 11.736532 | 3.464010 |
| 12.145749 | 3.570699 |
| 12.555245 | 3.676530 |
| 12.965019 | 3.781503 |
| 13.375069 | 3.885617 |
| 13.785392 | 3.988871 |
| 14.195987 | 4.091266 |
| 14.606851 | 4.192800 |
| 15.017983 | 4.293473 |
| 15.429380 | 4.393284 |
| 15.841041 | 4.492232 |
| 16.252964 | 4.590317 |
| 16.665145 | 4.687539 |
| 17.077585 | 4.783896 |
| 17.490279 | 4.879389 |
| 17.903227 | 4.974016 |
| 18.316426 | 5.067778 |
| 18.729874 | 5.160673 |
| 19.143569 | 5.252701 |
| 19.557510 | 5.343861 |
| 19.971694 | 5.434153 |
| 20.386118 | 5.523577 |
| 20.800782 | 5.612131 |
| 21.215682 | 5.699816 |
| 21.630818 | 5.786630 |
| 22.046186 | 5.872573 |
| 22.461785 | 5.957646 |
| 22.877613 | 6.041846 |
| 23.293667 | 6.125174 |
| 23.709947 | 6.207629 |
| 24.126448 | 6.289211 |
| 24.543170 | 6.369919 |
| 24.960111 | 6.449753 |
| 25.377268 | 6.528712 |
| 25.794640 | 6.606795 |
| 26.212223 | 6.684003 |
| 26.630017 | 6.760335 |
| 27.048019 | 6.835790 |
| 27.466228 | 6.910368 |
| 27.884640 | 6.984068 |
| 28.303254 | 7.056891 |
| 28.722068 | 7.128835 |
| 29.141080 | 7.199899 |
| 29.560288 | 7.270085 |
| 29.979690 | 7.339391 |
| 30.399283 | 7.407816 |
| 30.819066 | 7.475361 |
| 31.239036 | 7.542025 |
| 31.659192 | 7.607807 |
| 32.079531 | 7.672708 |
| 32.500052 | 7.736726 |
| 32.920751 | 7.799862 |
| 33.341628 | 7.862114 |
| 33.762681 | 7.923484 |
| 34.183906 | 7.983969 |
| 34.605302 | 8.043570 |
| 35.026867 | 8.102287 |
| 35.448598 | 8.160118 |
| 35.870495 | 8.217065 |
| 36.292554 | 8.273125 |
| 36.714774 | 8.328300 |
| 37.137152 | 8.382588 |
| 37.559687 | 8.435990 |
| 37.982376 | 8.488505 |
| 38.405217 | 8.540132 |
| 38.828209 | 8.590872 |

TABLE 1-continued

| X | Y |
|---|---|
| 39.251349 | 8.640723 |
| 39.674635 | 8.689686 |
| 40.098064 | 8.737761 |
| 40.521636 | 8.784947 |
| 40.945347 | 8.831243 |
| 41.369196 | 8.876650 |
| 41.793181 | 8.921167 |
| 42.217300 | 8.964794 |
| 42.641549 | 9.007530 |
| 43.065929 | 9.049376 |
| 43.490435 | 9.090330 |
| 43.915067 | 9.130394 |
| 44.339822 | 9.169566 |
| 44.764698 | 9.207846 |
| 45.189693 | 9.245234 |
| 45.614805 | 9.281730 |
| 46.040031 | 9.317333 |
| 46.465371 | 9.352044 |
| 46.890821 | 9.385861 |
| 47.316379 | 9.418785 |
| 47.742044 | 9.450816 |
| 48.167813 | 9.481953 |
| 48.593685 | 9.512197 |
| 49.019657 | 9.541546 |
| 49.445727 | 9.570000 |
| 49.871893 | 9.597561 |
| 50.298153 | 9.624226 |
| 50.724505 | 9.649997 |
| 51.150946 | 9.674872 |
| 51.577475 | 9.698852 |
| 52.004090 | 9.721937 |
| 52.430788 | 9.744126 |
| 52.857568 | 9.765419 |
| 53.284427 | 9.785817 |
| 53.711363 | 9.805318 |
| 54.138375 | 9.823923 |
| 54.565459 | 9.841631 |
| 54.992614 | 9.858443 |
| 55.419839 | 9.874358 |
| 55.847130 | 9.889376 |
| 56.274485 | 9.903497 |
| 56.701903 | 9.916721 |
| 57.129382 | 9.929048 |
| 57.556919 | 9.940478 |
| 57.984513 | 9.951010 |
| 58.412161 | 9.960644 |
| 58.839860 | 9.969381 |
| 59.267610 | 9.977220 |
| 59.695408 | 9.984161 |
| 60.123252 | 9.990204 |
| 60.551139 | 9.995349 |
| 60.979068 | 9.999596 |
| 61.407037 | 10.002945 |
| 61.835043 | 10.005395 |
| 62.263085 | 10.006947 |
| 62.691160 | 10.007601 |
| 63.119266 | 10.007356 |
| 63.547402 | 10.006213 |
| 63.975564 | 10.004171 |
| 64.403751 | 10.001231 |
| 64.831962 | 9.997392 |
| 65.260193 | 9.992654 |
| 65.688442 | 9.987018 |
| 66.116709 | 9.980483 |
| 66.544990 | 9.973049 |
| 66.973283 | 9.964717 |
| 67.401586 | 9.955486 |
| 67.829898 | 9.945356 |
| 68.258216 | 9.934327 |
| 68.686538 | 9.922409 |
| 69.114862 | 9.909574 |
| 69.543186 | 9.895849 |
| 69.971508 | 9.881226 |
| 70.399825 | 9.865704 |
| 70.828136 | 9.849283 |
| 71.256439 | 9.831964 |
| 71.684730 | 9.813746 |

TABLE 1-continued

| X | Y |
|---|---|
| 72.113010 | 9.794630 |
| 72.541274 | 9.774615 |
| 72.969522 | 9.753702 |
| 73.397751 | 9.731890 |
| 73.825959 | 9.709181 |
| 74.254144 | 9.685573 |
| 74.682304 | 9.661067 |
| 75.110436 | 9.635663 |
| 75.538539 | 9.609360 |
| 75.966611 | 9.582160 |
| 76.394649 | 9.554063 |
| 76.822652 | 9.525067 |
| 77.250617 | 9.495174 |
| 77.678542 | 9.464384 |
| 78.106425 | 9.432696 |
| 78.534265 | 9.400111 |
| 78.962058 | 9.366628 |
| 79.389804 | 9.332249 |
| 79.817499 | 9.296973 |
| 80.245142 | 9.260800 |
| 80.672731 | 9.223730 |
| 81.100263 | 9.185764 |
| 81.527737 | 9.146902 |
| 81.955150 | 9.107143 |
| 82.382501 | 9.066489 |
| 82.809787 | 9.024939 |
| 83.237006 | 8.982493 |
| 83.664156 | 8.939151 |
| 84.091236 | 8.894914 |
| 84.518242 | 8.849782 |
| 84.945173 | 8.803755 |
| 85.372028 | 8.756833 |
| 85.798803 | 8.709017 |
| 86.225496 | 8.660306 |
| 86.652106 | 8.610702 |
| 87.078631 | 8.560203 |
| 87.505069 | 8.508810 |
| 87.931416 | 8.456524 |
| 88.357672 | 8.403345 |
| 88.783835 | 8.349272 |
| 89.209901 | 8.294307 |
| 89.635870 | 8.238449 |
| 90.061738 | 8.181699 |
| 90.487505 | 8.124056 |
| 90.913168 | 8.065522 |
| 91.338724 | 8.006096 |
| 91.764173 | 7.945779 |
| 92.189511 | 7.884570 |
| 92.614736 | 7.822471 |
| 93.039848 | 7.759482 |
| 93.464843 | 7.695602 |
| 93.889719 | 7.630832 |
| 94.314475 | 7.565172 |
| 94.739108 | 7.498623 |
| 95.163616 | 7.431185 |
| 95.587998 | 7.362858 |
| 96.012251 | 7.293642 |
| 96.436373 | 7.223539 |
| 96.860362 | 7.152547 |
| 97.284216 | 7.080668 |
| 97.707933 | 7.007902 |
| 98.131511 | 6.934249 |
| 98.554948 | 6.859709 |
| 98.978242 | 6.784283 |
| 99.401391 | 6.707971 |
| 99.824392 | 6.630774 |
| 100.247244 | 6.552691 |
| 100.669944 | 6.473724 |
| 101.092491 | 6.393872 |
| 101.514883 | 6.313136 |
| 101.937117 | 6.231517 |
| 102.359191 | 6.149014 |
| 102.781104 | 6.065628 |
| 103.202853 | 5.981359 |
| 103.624437 | 5.896208 |
| 104.045853 | 5.810176 |
| 104.467099 | 5.723262 |

TABLE 1-continued

| X | Y |
|---|---|
| 104.888173 | 5.635467 |
| 105.309073 | 5.546792 |
| 105.729798 | 5.457236 |
| 106.150344 | 5.366801 |
| 106.570711 | 5.275486 |
| 106.990895 | 5.183292 |
| 107.410896 | 5.090220 |
| 107.830710 | 4.996270 |
| 108.250337 | 4.901442 |
| 108.669773 | 4.805737 |
| 109.089017 | 4.709155 |
| 109.508067 | 4.611698 |
| 109.926921 | 4.513364 |
| 110.345576 | 4.414155 |
| 110.764031 | 4.314071 |
| 111.182284 | 4.213112 |
| 111.600333 | 4.111280 |
| 112.018175 | 4.008574 |
| 112.435809 | 3.904996 |
| 112.853233 | 3.800545 |
| 113.270444 | 3.695222 |
| 113.687441 | 3.589027 |
| 114.104222 | 3.481961 |
| 114.520784 | 3.374025 |
| 114.937125 | 3.265219 |
| 115.353244 | 3.155544 |
| 115.769139 | 3.044999 |
| 116.184807 | 2.933587 |
| 116.600247 | 2.821306 |
| 117.015456 | 2.708158 |
| 117.430433 | 2.594143 |
| 117.845175 | 2.479262 |
| 118.259681 | 2.363516 |
| 118.673948 | 2.246904 |
| 119.087975 | 2.129427 |
| 119.501759 | 2.011087 |
| 119.915299 | 1.891883 |
| 120.328592 | 1.771816 |
| 120.741637 | 1.650887 |
| 121.154431 | 1.529096 |
| 121.566973 | 1.406444 |
| 121.979261 | 1.282931 |
| 122.391291 | 1.158559 |
| 122.803064 | 1.033327 |
| 123.214576 | 0.907236 |
| 123.625825 | 0.780287 |
| 124.036811 | 0.652481 |
| 124.447529 | 0.523817 |
| 124.857980 | 0.394298 |
| 125.268160 | 0.263922 |
| 125.678067 | 0.132692 |
| 126.087701 | 0.000607 |

A pump casing can be divided into convenient sizes and manufactured in sections. Finished parts can be assembled with nuts and bolts provided in the package, following instructions, to form a casing of the desired curvature.

Figure 9:
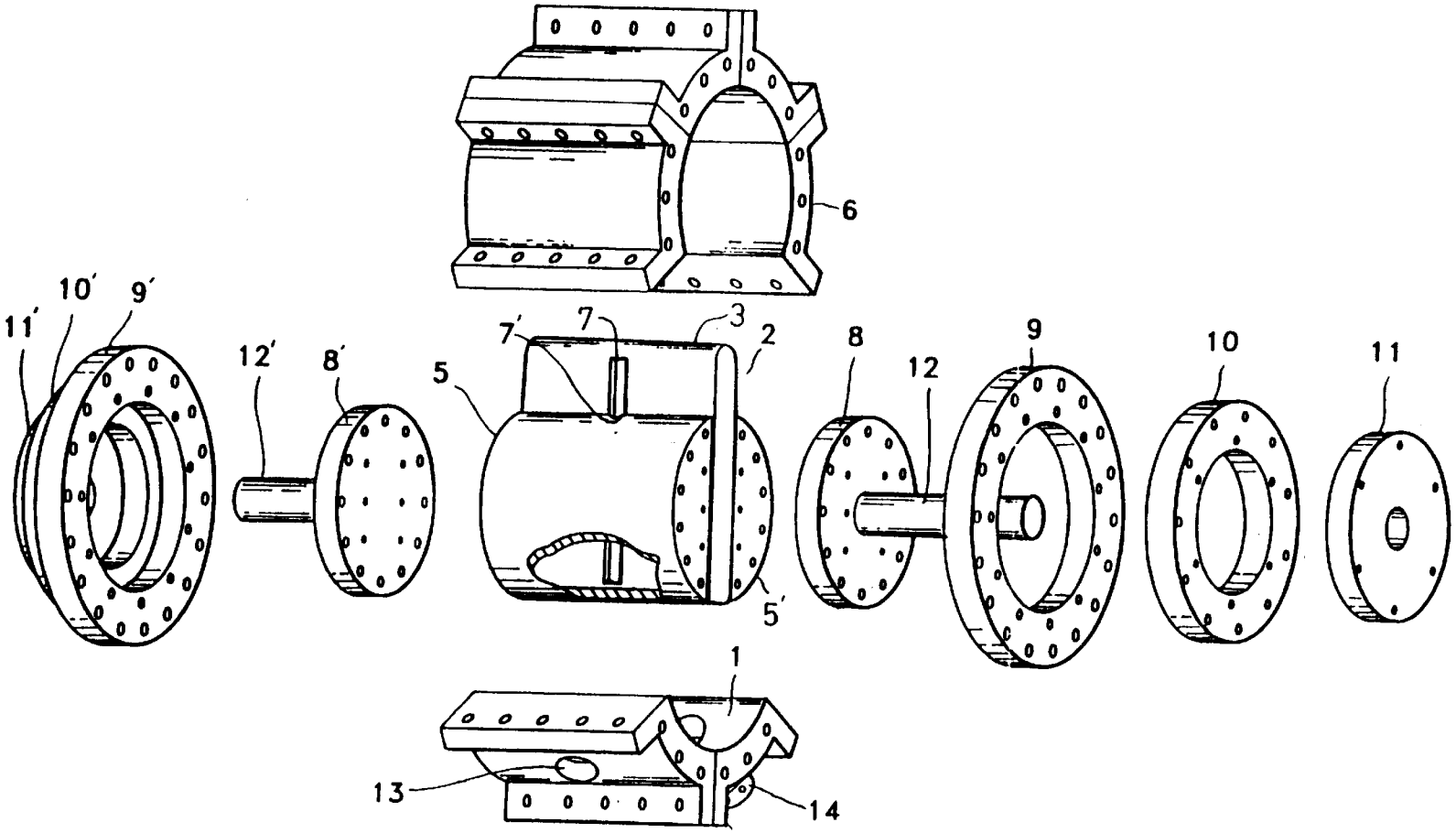
FIG. 9 describes an eccentric rotor vane pump of horizontal design.
Figure 10:
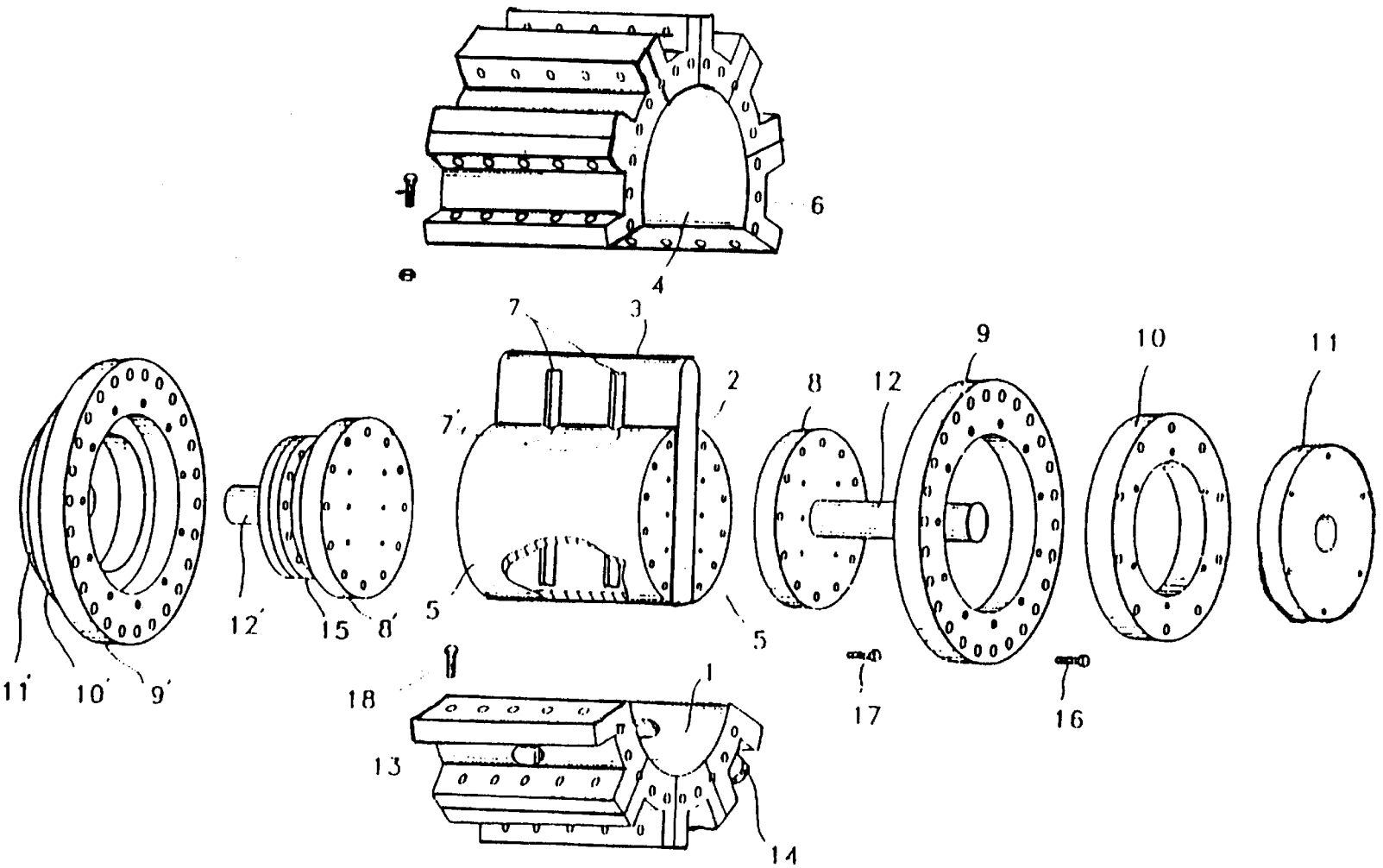
FIG. 10 describes an eccentric rotor vane pump of vertical design.
Figure 11:
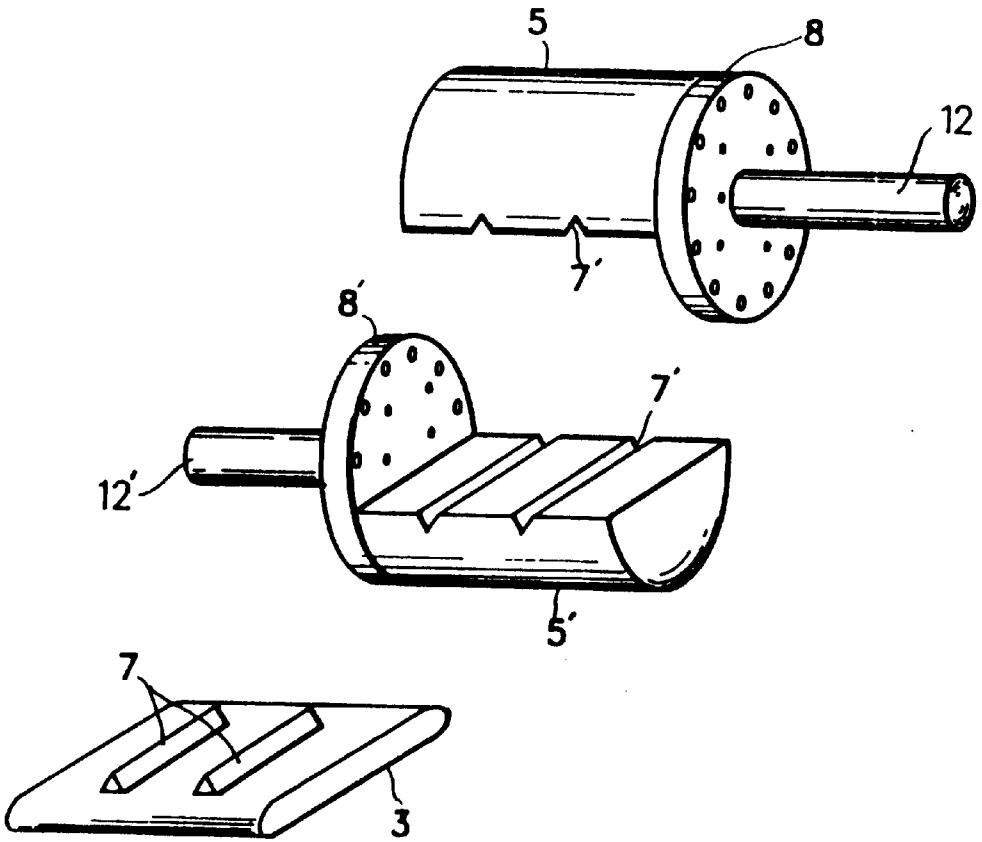
FIG. 11 displays the components of the eccentric rotor vane pump described in this invention.

FIG. 9 describes the disassembled parts of an eccentric rotor vane pump of horizontal design, and FIG. 10 describes the disassembled parts of an eccentric rotor vane pump of vertical design. FIG. 11 shows the components of the eccentric rotor vane pump described in this invention. In the manufacture of large-sized casings using the existing manufacturing method, the entire casing is manufactured as a single piece and the size of the rotor increases in proportion to the size of the casing. In this case the processing of the accurate guide surface which meets with the sliding, scraping vane is severely disabled. In order to overcome this limitation, two semi-circular rotors (5 and 5') are separately manufactured, as shown in FIG. 11. On the inside of each semi-circular rotor, guide grooves (7') are formed to match the projecting parts ⑦ on both sides of vane ③, so that the projecting parts can move along the grooves when the vane slides back and forth. The casing parts (1 and 6) are held together with bolts and side covers (9 and 9') are tightly placed on the open sides of the casing also using bolts. The rotating discs (8 and 8') drives the eccentric rotor (2) to otates in close contact with the inner surface of the casing. The sealing parts (10 and 10') are fitted inside the side covers (9 and 9'), and sealing liquid is applied to the contacting surfaces between the sealing parts and the rotating discs (8 and 8') and shafts (12 and 12'). The bearing boxes (11 and 11') are attached to the sealing parts using bolts, to support the rotating shafts (12 and 12').

The reference number 13 denotes the fluid inlet and the number 14, the fluid outlet. The number 16, 17 and 18 in the figures refer to bolts and nuts provided in the package. The number 15 in FIG. 10 denotes the thrust bearing which is used to support the weight of an eccentric rotor oI vertical shaft.

In an eccentric rotor vane pump of vertical shaft as shown in FIG. 10, the rotor experiences increasing weight as casing size increases. In addition to the lower shaft and the bearing in the bearing box, therefore, a large-sized pump as an in-built thrust bearing to support the weight and thus allow smooth rotations regardless of the rotor weight. As casing size increases, weight of the vane also increases. For this reason, vane ③ is designed to reciprocate horizontally, along the guide faces of the vertical axial rotor. So the vane can slide and scrape the inner surface of the casing in close contact, no matter how large casing size and vane weight may be. Friction and centrifugal force generated by the rotating vane of a large-sized pump can also be greatly reduced. The weight of vane ③ still affects the horizontal movement of the vane, while due to horizontal rotations the two ends of the vane, sliding and scraping in contact with the curved surface of the casing, can no longer affect the gravitational pull on the vane. Therefore vane ③ is designed to contain the appropriate number of convex parts (7), and the semi-circular rotors, the same number of grooves (7') as convex parts. Or a suitable device such as beating is installed at the center of mass on the upper or bottom side of the vane, so as to absorb and reduce the weight of vane ③. As a result, the eccentric rotor vane pump of this design can undertake smooth horizontal movement, which is one of the major purports of this invention.

Springless eccentric rotor vane pumps (of either horizontal or vertical shaft) with cardiocle and expanded cardioid casings derived from Equations (5) and (6), as explained above, solve the limitations of, and problems posed by, current eccentric rotor vane pumps. Processing of large-size pumps is now possible with mathematical formation of casing curatures, hitherto regarded as impossible. In addition, as these pumps can perform more revolutions per unit time, pump size can be greatly reduced; pumps one-fifth the size of curtent large-size, large-output pumps can produce the same amounts of output. Moreover the achievement of exact mathematical descriptions of the cardiocle and expanded cardioid is opening a new chapter in pump technology in terms of analytic geometry.

The following section on 'what is claimed' merely suggests a few applications of this invention. Further changes or corrections are still possible, but these are conceptually part of the invention.

What is claimed is:

1. A method of manufacturing casing curved surfaces for eccentric rotor vane pumps, wherein the cardiocle curvature of the casing in a springless eccentric rotor vane pump can be represented over the range $0° \leqq \theta \leqq 180°$ as $$X^2+Y^2=\{2\sqrt{r(2R-r)}+(R-r)\sin\theta-\sqrt{R^{2-(R-r)^2\cos^2\theta}}\}^2,$$

$$P=2\sqrt{r(2R-r)}+(R-r)\sin\theta-\sqrt{R^{2-(R-r)^2\cos^2\theta}}$$

$$P=2a\left(1+(R-r)\frac{\sin\theta}{2a}-\frac{\sqrt{R^2-(R-r)^2\cos^2\theta}}{2a}\right),$$

and $$X^2+Y^2=(\sqrt{R^{2-(R-r)^2\cos^2\theta}}-(R-r)\sin\theta)^2, \text{ or}$$

$$P=\sqrt{R^2-(R-r)^2\cos^2\theta}-(R-r)\sin\theta,$$

where X and Y are Cartesian coordinates, r denoites the radius of the rotor, R denotes the radius of the basic circle, θ denotes the rotation angle of the rotor or vane, and P is a polar coordinate, whereby the above equations being implemented in the precision manufacture of the curved surface of the casing in the eccentric rotor vane pump using CNC techniques.

2. The method according to claim 1, wherein the equation for the expanded cardioid curvature of the casing over the range $0°\leqq\theta\leqq360°$ can be written as $$P=2a\left\{1+(R-r)\frac{\sin\theta}{2a}\right\},$$

which can be directly applied for the manufacture of the curved surface of the casing in the eccentric rotor vane pump, using CNC techniques.

3. The method according to claim 1 or 2, wherein the curved surface of the casing in the eccentric rotor vane pump is designed and manufactured in sections, which are then assembled.

4. A method of machining casing curved surfaces for eccentric rotor vane pumps, wherein the cardiocle curvature of the casing in a springless eccentric rotor vane pump can be represented over the range $0°\leqq\theta\leqq180°$ as $$X^2+Y^2=\{2\sqrt{r(2R-r)}+(R-r)\sin\theta-\sqrt{R^{2-(R-r)^2\cos^2\theta}}\}^2,$$

$$P=2\sqrt{r(2R-r)}+(R-r)\sin\theta-\sqrt{R^{2-(R-r)^2\cos^2\theta}}$$

$$P=2a\left(1+(R-r)\frac{\sin\theta}{2a}-\frac{\sqrt{R^2-(R-r)^2\cos^2\theta}}{2a}\right),$$

and $$X^2+Y^2=(\sqrt{R^{2-(R-r)^2\cos^2\theta}}-(R-r)\sin\theta)^2, \text{ or}$$

$$P=\sqrt{R^2-(R-r)^2\cos^2\theta}-(R-r)\sin\theta,$$

where X and Y are Cartesian coordinates, r denotes the radius of the rotor, R denotes the radius of the basic circle, θ denotes the rotation angle of the rotor or vane, and P is a polar coordinate, the above quations being implemented in the precision manufacture of the curved surface of the casing in the eccentric rotor vane pump, using CNC techniques.

5. The method according to claim 4, wherein the equation for the expanded cardioid curvature of the casing over the range $180°\leqq\theta\leqq360°$ can be written as $$P=2a\left\{1+(R-r)\frac{\sin\theta}{2a}\right\},$$

which can be directly applied for the manufacture of the curved surface of the casing in the eccentric rotor vane pump, using CNC techniques.

* * * * *